US007273976B2

(12) United States Patent
Bennett

(10) Patent No.: US 7,273,976 B2
(45) Date of Patent: Sep. 25, 2007

(54) NON-ORGANIC OPEN-FRAMED CHORDED ZITHER/AUTOHARP WITH MULTIPLE INTERCHANGEABLE SOUND CHAMBERS

(76) Inventor: John E. Bennett, 8312 8th Ave. NE., Seattle, WA (US) 98115

( * ) Notice: Subject to any disclaimer, the term of this patent is extended or adjusted under 35 U.S.C. 154(b) by 478 days.

(21) Appl. No.: 10/827,461

(22) Filed: Apr. 19, 2004

(65) Prior Publication Data

US 2005/0241455 A1 Nov. 3, 2005

(51) Int. Cl.
*G10D 1/12* (2006.01)

(52) U.S. Cl. ..... 84/285

(58) Field of Classification Search ..... 84/285–289
See application file for complete search history.

(56) References Cited

U.S. PATENT DOCUMENTS

| | | | | |
|---|---|---|---|---|
| 3,515,026 | A * | 6/1970 | Rohrbough | 84/286 |
| 4,481,855 | A | 11/1984 | Bozung | |
| 5,052,259 | A * | 10/1991 | Orthey et al. | 84/288 |
| 2005/0155480 | A1 * | 7/2005 | Joseph | 84/299 |

* cited by examiner

*Primary Examiner*—Kimberly Lockett
(74) *Attorney, Agent, or Firm*—Jensen & Puntigam PS

(57) ABSTRACT

A chorded zither including a self-supporting metal frame with separate and structurally independent sound board panels that can be easily interchanged and affixed to said frame to create different looking and sounding instrument configurations with the same basic instrument, including sound chambers that are deeper and greater in volume than those of the prior art.

4 Claims, 4 Drawing Sheets

FIG. 3
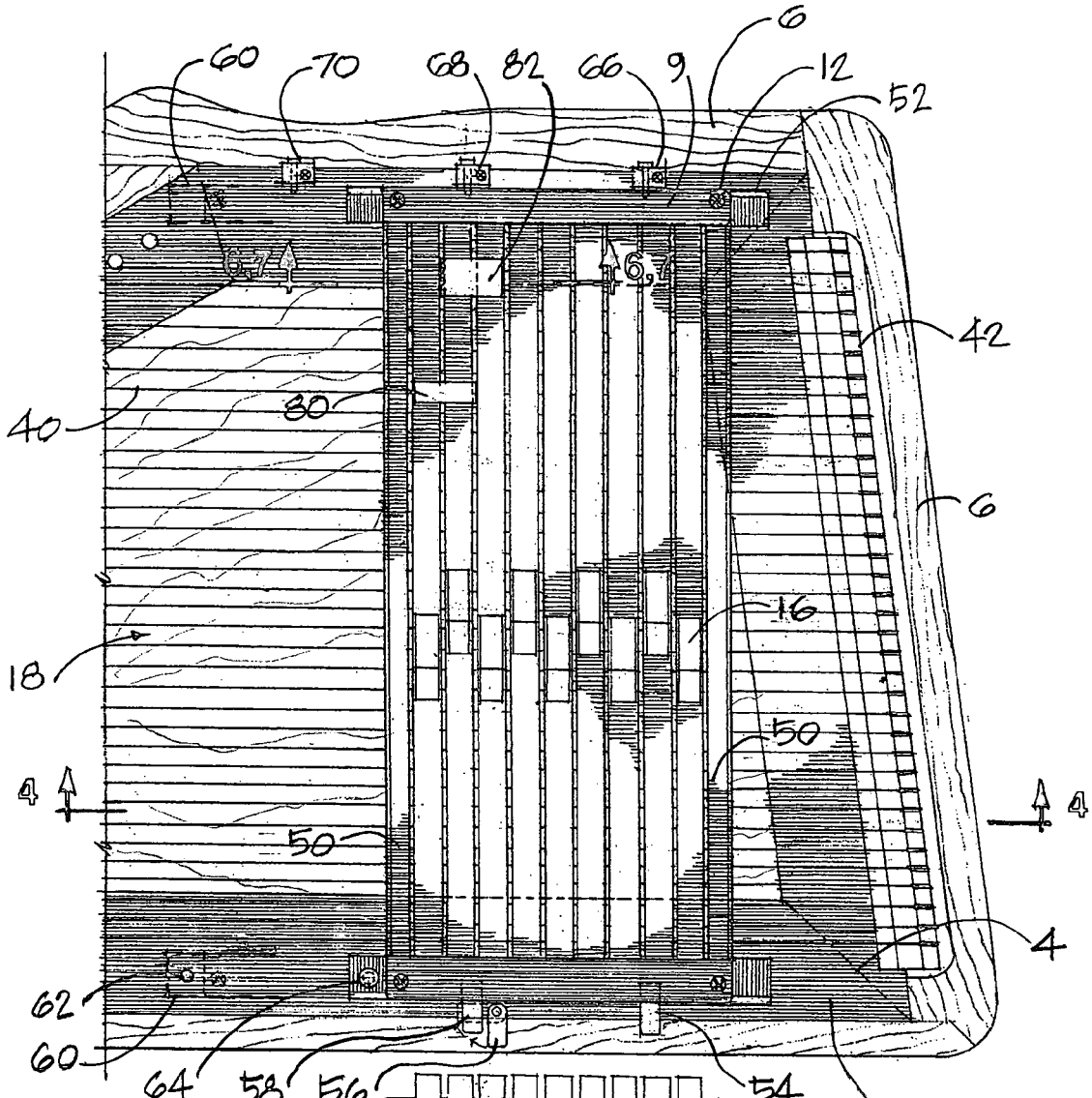
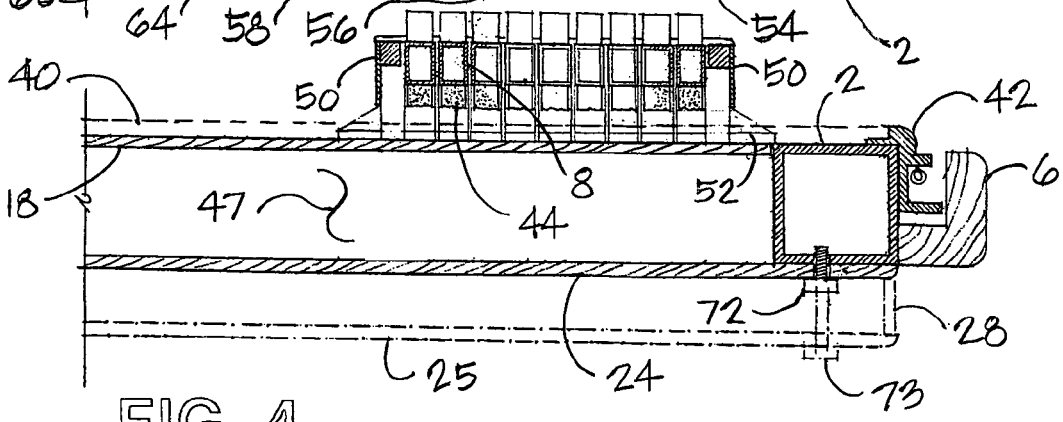
FIG. 4

NON-ORGANIC OPEN-FRAMED CHORDED ZITHER/AUTOHARP WITH MULTIPLE INTERCHANGEABLE SOUND CHAMBERS

TECHNICAL FIELD

This invention relates to design improvements to chorded zithers incorporating a strong, light-weight non-organic frame that allows interchangeability of sound chamber configurations including larger chamber volumes than the prior art; a doubling of strings for fuller sound; and a quickly removable chord bar assembly with harmonic dampening devices for improved flexibility and range of available chords.

The present invention with its superior strength-to-weight ratio allows at least 55 strings to be installed on an instrument of similar size to the prior art without any noticeable or objectionable deflection of the frame. This allows for a fuller and brighter sound to the instrument as approximately 40% more strings are played with a given chord.

The present invention includes a small device that can be retrofit to a given chord bar to bridge over its adjacent chord bar to go down in the space between chord bars to impact, when said chord bar is played, the string with the objectionable harmonic. By impacting the problem string at a point slightly off of its harmonic point, said objectionable harmonic in eliminated. This device by bridging high enough over the adjacent chord bar does not affect the playability of the instrument.

BACKGROUND ART

Frame and Body Construction

The prior art chorded zither typically incorporates a hardwood frame or pin block of either solid hardwood or laminated-ply wood material that is permanently bonded with glue to a wood top and back panel forming a hollow sound chamber and at the same time creates a rigid box structure capable as a unit of resisting the substantial forces produced by a multiplicity of 36 or 37 tuned strings (approximately 40 pounds per string). The front and back facing panels, being firmly glued to the solid wood perimeter support frame of the instrument's body are an integral composite of the string tension-resisting support structure. With this basic structural assembly there is no interchangeability potential of the basic instrument involving appearance or sound chamber variations. The limitations of this traditional configuration are in the trade-offs between strength (string support), acoustical sound (thinner facing components and minimal mass), and overall weight and size (portability). A deeper frame for example would create a stronger frame with a fuller sound but would substantially increase overall weight. Lighter framing and facing materials would improve sound and weight but would be structurally less able to resist string tension, maintain tuning stability (affected by humidity), and provide consistent chord bar contact with the string plane (caused by warping). In all configurations of the prior art there is little potential for significant tonal or aesthetic modification with the same instrument frame except for string tuning variations (diatonic vs. chromatic—see also discussion below) or chording variations (changing chord bar configurations). String quantities on instruments of the prior art are generally limited to 36 or 37 by a balancing of assets based on strength, acoustics, physical size, and overall weight.

String Configurations and Quantities

A chorded zither/autoharp musician must typically make the choice between acquiring a "diatonic" or "chromatic" style instrument. The chromatic style (historically the most common) provides strings for the full range of available notes in the chromatic scale within each of the octaves of the instrument, thus including all the "sharped" strings, i.e. C, C#, D, D#, E, F, F#, G, G#, A, A#, B, C. This is analogous to providing the white and the black keys on a piano for each octave provided. The lower or bass strings are severely limited in the interests of saving space for the mid-range and higher strings which provide the capacity for melody play. The advantage of a chromatically strung and configured autoharp is that it can play any possible chord in any possible key as long as a chord bar is available on the instrument to play said chord in said key. This provides the musician with the ability to play in a few different keys with a given chord configuration and/or to include a few specialty chords (or "color chords") which potentially enrich a given musical composition. It also allows the musician more flexibility to potentially play with musical groups who utilize keys not typically standard with the chorded zither. The definitive term for chromatic style instruments is "flexibility". This "flexibility" of available chords is however encumbered by the inconvenience of exchanging chord bars within the chord bar frames of instruments of the prior art (see also discussion below). The introduction of "lock bars" (see also Orthey, Jr., et al. U.S. Pat. No. 5,052,259) allows a chromatic style harp to achieve one of the significant benefits of diatonic style chorded zithers by dampening out all of the strings on the instrument that are not part of the desired playing key selected by the musician, thus allowing the availability of "open chording" (strumming or plucking the strings without pressing down a chord bar. (See also discussion below regarding diatonic style chorded zithers.)

The diatonic style chorded zither on the other hand provides strings with a limited range of available notes in the chromatic scale within each of the octaves of the instrument, thus eliminating all but the diatonic strings necessary to play in the desired key(s). I.e. for the key of C the only notes available would be C, D, E, F, G, A, and B for each octave. This is analogous to providing only the white keys on a piano for each octave provided. The advantage to a diatonically strung and configured chorded zither is that although it can play in a very limited number of keys, it produces a fuller sound for each chord by increasing the number of strings that "play" with each chord. The strings that are eliminated by reduction of possible chords are converted to extra notes (i.e. doubled strings) that play in each chord. The number of overall strings that play in each chord is inversely proportional to the number of chords on the instrument. This provides the musician with the benefit of greater sound quality and fullness. Some musicians maximize this benefit by setting each instrument up to play in only one key! These instruments with their smaller overall number of chords also typically provide the musician with a greater playing area over the strings and much less potential for having problems with harmonics (the inability to effectively dampen certain strings due to their position under the chord dampening pads). "Open chording" (the ability to strum or pluck stings without dampening out any strings on the instrument) is also enhanced with the diatonic style, although "lock bars" are still necessary for each key to provide the cleanest sound with this playing technique (none is required if only one key is available on the autoharp). While the sound quality of the diatonic style instrument is much improved over ones of the chromatic style the disadvantages are great. Among them are: the need for purchasing more instruments in order to play in more keys, the inability to include specialty "color chords" in each key, the logistical problem for performers of having to travel with multiple instruments and then contend functionally with them on stage, and the greatly reduced ability to "match-up" musically with the keys played by other musicians using other types of instruments. The definitive term for diatonic style instruments is "sound quality".

The number of strings on chorded zithers/autoharps of the prior art is usually 36 or 37, although some variations have gone to higher numbers for greater tonal range or smaller numbers of strings to produce a lighter instrument with improved vibration transfer onto the sound board. The instruments with greater numbers of strings than 37 get larger and heavier and sound quality begins to diminish, and their portability and playability in an upright-held position is compromised. To resist the greater structural tension of the strings the wood frames must be large and heavy (see also previous patents) and the potential for string-tune and flat-chord-plane destabilization is increased. Also, the potential for splitting, joint cracking, or warping failure of the wood components is increased with the higher tensioning required onto pins in close proximity to each other. A failure of this type would typically render the instrument useless. The instruments with smaller numbers of strings, while allowing improved tonal transfer from the strings to the sound chamber via the bridge, takes away from the number of strings that can be played with a given chord as well as the overall number of chords that can be accommodated on the instrument.

Chord Bar Design and Harmonics Avoidance

Chorded zithers and/or autoharps of the prior art all contain chord bars (8) which are positioned over the strings (40) and which have pre-cut string dampening pads (44). (See FIGS. 1 and 2 for a typical example of a chord bar arrangement of the prior art.) When the chord bar is pressed firmly down on the strings below, the contact of the dampening pads on the strings keeps those strings which are not part of the desired chord from sounding. (I.e. the strings desired to be part of the chord pressed fall at points where the dampening padding has been cut away.) Groupings of chords are typically of 12, 15, or 21 with 21 providing the greatest flexibility and the least amount of playing space in the high range for the musician's fingers. Said chord bars are retained on the autoharp most commonly in one of two different ways: set into slots with small springs (see (90) in FIGS. 6,7) at the bottom of the slots (to allow the bars to return up off of the strings after being pressed) and a retaining device (10) to keep them from falling out of the slots if the instrument is turned over; or the chord bars are set over small post assemblies (sometimes called "combs" for their general appearance) with small springs, or bent spring flaps instead of springs, and also incorporating retaining devices. The slots and post assemblies are firmly screwed to the body of the instrument for proper alignment with the last chord bars in the sequence exposed at the ends of the overall grouping. (See FIGS. 1 and 2 for a typical chord bar arrangement for items (10), (14), and (8) attached to the main body of the autoharp.) Advancements have been made to instruments of the prior art to allow their chord bar retainers to be easily and quickly removed to permit, in turn, the musician to remove and replace individual chord bars into the slots or over the posts, with the overall chord bar housing (14) staying firmly affixed to the autoharp. However, the practicality of executing this exchange during say an on-stage performance is too risky, cumbersome, and time-consuming for most performers to undertake. It takes a degree of concentration to keep from mixing up the bars (or dropping them!) and if they are placed in the wrong position, the musician will be unable to effectively play the instrument. The common mode of operation, therefore, is to have multiple instruments on stage to ease the problematic nature of exchanging chord bars between songs and to provide a full range of "color chords" literally at one's fingertips.

Non-professional autoharp musicians tend to play with the most common chord bars required for a reasonable range of tonal keys and tend to forgo trying to accommodate "color chords" (those which add more tonal interest to a given composition). They also will often forego playing in some desired keys to avoid buying and keeping more than one autoharp. Most instruments of the "chromatic" style configuration contain as many chords as possible, along with "lock bars" for diatonic style play, to eliminate the need for having additional instruments to cover extra desired tonal keys. The practical limit for typical autoharps is 21 chord bars, which leaves very little physical space to play the shortest strings on the instrument. Because of this problem professional autoharp players often will carry several autoharps to concerts to allow finger room to play in the different keys required for their repertoire. The more chord bars on the autoharp the less space for the musician's fingers to strum and pluck the stings. Thus, fewer chord bars enhances playing potential.

Some autoharp players prefer the sound of strings that are plucked or strummed closer to the bottom slotted string bridge (42) and therefore make the decision to mount the chord retaining device (14) further away from the bridge to allow finger movement space over the lower portion of the autoharp. This effectively eliminates their ability to play sound selections on the same instrument that would benefit from the softer sounds that result from plucking and strumming strings closer to the center of the strings. In addition, when chord bars are mounted closer to the center of the autoharp the potential for discordant harmonics is greater since many possibilities in this configuration exist for dampening pads to impact strings at their midpoints or third points.

Harmonics Avoidance

The prior art of chorded zithers/autoharps has been significantly encumbered by the problem of discordant harmonic sounds compromising otherwise harmonious-sounding chords. The problem manifests itself when a string dampening chord bar pad (44) of the instrument contacts a string (that is not desired in the particular chord) at a harmonic point (usually at one half or one third its span from bridge-to-bridge) and is unable therefore to fully dampen the sound of said string. The resultant ring-through sound diminishes the quality and clarity of the desired chord. It is very difficult to avoid every harmonic point on a chorded zither/autoharp, especially in chromatically configured instruments with more than 15 chord bars. (If only a few chord bars are provided on the instrument they usually avoid the most problematic harmonic points.) It is also difficult to avoid the harmonic problem points in instruments where the chord bars can be removed individually and replaced with chord bars in different keys, because it is virtually impossible to position all possible chords so that no dampening pads will hit a harmonic point on the strings. When instruments are set up with the chord bars mounted further from the bottom string bridge the problem becomes more acute since the number of potential harmonic points increases.

The prior art attempts to avoid the majority of problems by two general methodologies: 1) Reducing the quantity of chord bars that can be played on a given instrument, thus keeping the number of chord bars that physically begin to overlap the harmonic zones at a minimum, or 2) Positioning as many chord bars as possible just off of the harmonic problem points. Some autoharp instrument builders have tried to revise the design of the dampening pad itself to minimize the problem harmonic but with limited results because the footprint of the dampening pad still falls within the string's harmonic zone.

DISCLOSURE OF INVENTION

The self-supporting frame of the present invention resists all string tension by the strength of the lightweight non-organic frame leaving the sound chamber design flexible for lighter panel elements, as well as different and interchangeable configurations that can be replaced at any time after the instrument is constructed, tuned and ready for playing.

The present invention allows an entire group of chord bars to be removed as a single unit within a few seconds and with total registration accuracy over the strings. This means that a performer can acquire multiple chord assemblies that can be easily interchanged with the same instrument thus taking up far less space logistically than multiple instruments and reducing costs by a substantial amount. It also allows the chord group assemblies to be smaller (housing fewer chord bars) without restricting the instrument's readily available key potential, which has the benefit of increasing playability by increasing the available area over the strings for the musician's hand.

Chord bar retaining device configurations of the prior art are permanently fixed to the body of the instrument for proper alignment with the strings. The element of these assemblies that actually keeps the chord bar in place can be removed, thus allowing the individual chord bars to be removed and replaced by different chord bars. However, since they have to be replaced in a one-at-a-time-manner, it becomes impractical to change chords very effectively each time a musician wants to play in a different key or with different particular individual chords. There is also the restriction of the number of chord bars that can be retained on a given instrument without adversely affecting the musician's ability to physically play the shortest strings. For these reasons performers wanting the versatility of playing in different keys will purchase multiple instruments to avoid the practical difficulties encountered with exchanging individual chord bars.

The present invention allows an entire group of chord bars to be removed as a single unit within a few seconds and with total registration accuracy over the strings. This means that a performer can acquire multiple chord assemblies that can be easily interchanged with the same instrument, thus taking up far less space logistically than multiple instruments and reducing costs by a substantial amount. It also allows the chord group assemblies to be smaller (housing fewer chord bars) without restricting the instrument's readily available key potential, which has the benefit of increasing playability by increasing the available area over the strings for the musician's hand.

Chorded zithers of the prior art have no effective way to eliminate discordant harmonic tones that occur when a chord bar's dampening pad contacts a string at its harmonic point. These harmonic points typically occur at mid-span or one-third span points of a given string (from bridge-to-bridge). The more chord bars that are contained on an instrument, the higher the likelihood that harmonics will "contaminate" an otherwise pleasing-sounding chord.

The present invention includes a small device that can be retrofitted to a given chord bar to bridge over its adjacent chord bar to go down in the space between chord bars to impact, when said chord bar is played, the string with the objectionable harmonic. By impacting the problem string at a point slightly off of its harmonic point, said objectionable harmonic is eliminated. This device, by bridging high enough over the adjacent chord bar, does not affect the playability of the instrument.

BRIEF DESCRIPTION OF THE DRAWINGS

FIG. 3 is a partial plan view of the instrument of FIG. 1 with the unitized chord bar assembly of the present invention.

FIG. 4 is a partial longitudinal section cut through the unitized chord bar along lines 3-3 of FIG. 3. Note that the back panel attached to the frame is shown without the spacer ring described in FIG. 1 above.)

BEST MODE FOR CARRYING OUT THE INVENTION

Brief Descriptions of Elements of the Invention

A chorded zither (or autoharp by common terms) comprising a self-supporting non-organic frame (2) with separate and structurally independent sound board panels (18, 24,28) that can be quickly and easily interchanged and affixed to said frame (2) to create different looking and sounding instrument configurations with the same basic instrument, including sound chambers that are deeper (46) and greater in volumetric dimension than those of the prior art.

Said non-organic frame (2) (see FIGS. 1, 2, and 3) can be configured to permit support for doubled strings (36,38) in strategic portions of the instrument's tonal range (said doubling similar to, for example, a 12-string versus a 6-string guitar). This configuration with either an open-frame, or bonded facing panel at the top side only, combining wood or metal facing panels permanently affixed to said non-organic frame, allows a single autoharp to be configured for "chromatic" tuning and chord bars while yielding a "diatonic" sounding instrument. (See discussion for "The Present Invention (String Configurations and Quantities)")

A unitized chord bar retaining assembly, also referred to by the inventor as a "chord cartridge", (8, 10, 16, 44, 52, 54, 58) for a chorded zither or autoharp (see FIGS. 4 and 5) that provides the autoharp player the ability to quickly and easily remove and replace entire chord bar clusters on any given instrument of either the present or prior art by quick release attachment devices. (54, 56, 58, 66, 68, 70). This invention is particularly applicable to chorded zithers and autoharps with stings tuned for "chromatic" style play and gives the autoharpist the ability to effectively play the instrument in any key desired with any desired chord grouping arrangement.

Figure 6:
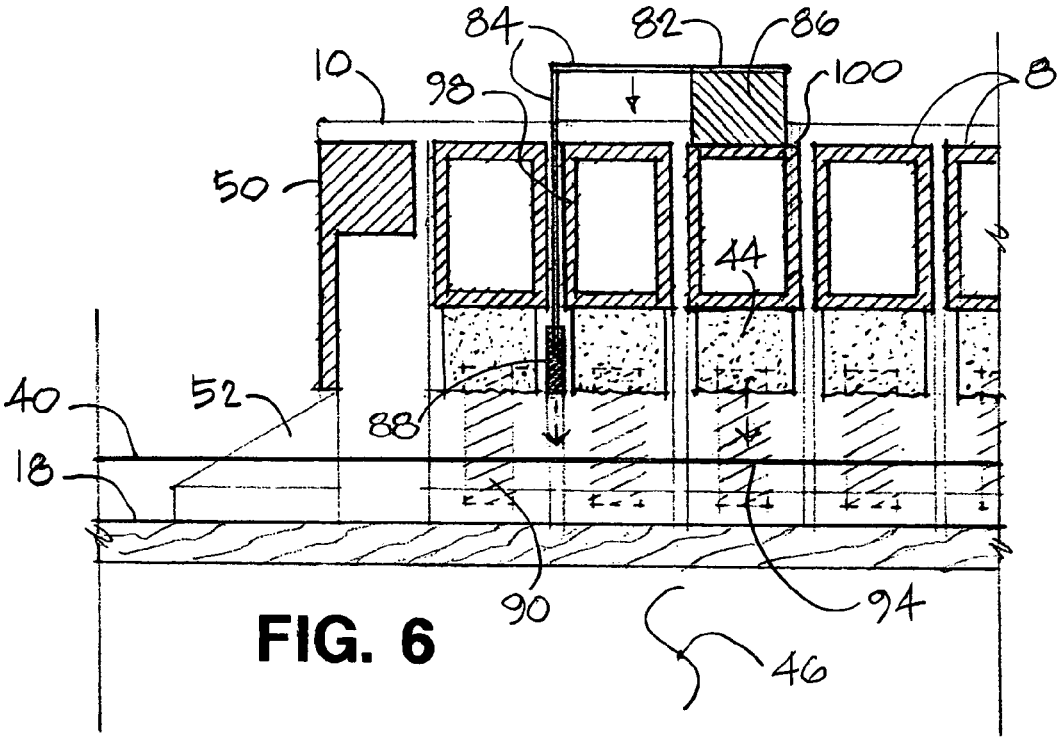
FIG. 6 is a partial cross section through the unitized chord bar assembly of FIGS. 3, 4, and 5 along lines 6-6 of FIG. 3, with the harmonic dampening device attached to a chord bar shown in the inactive position.
Figure 7:
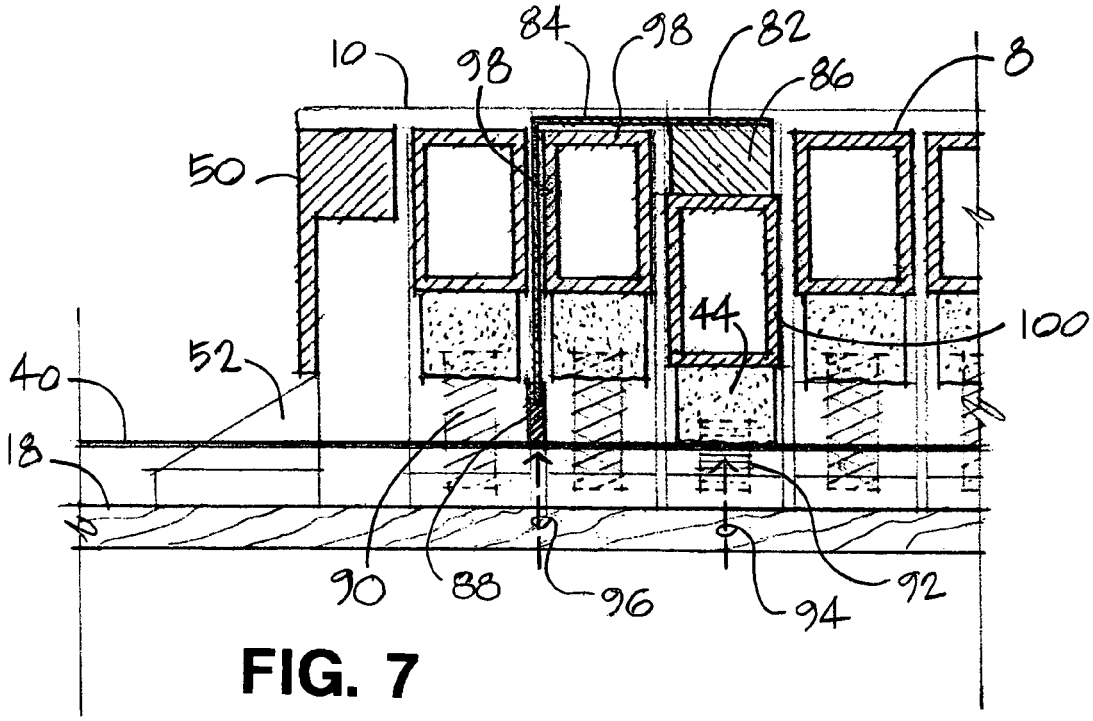
FIG. 7 is the same partial cross section of FIG. 6 above (cutting through the unitized chord bar assembly described in FIGS. 3, 4, and 5 above) with the same harmonic dampening device shown in its active position.

An associated element of this invention includes a device (80, 82) which when affixed to the appropriate chord bar (100) as shown in FIGS. 6 and 7, bridges over its adjacent chord bar (98) to effect an improved dampening point (96 on FIG. 7) on a string (40), that otherwise occurs at a discordant harmonic point (94 on FIG. 8) for said chord bar when pressed against the instrument's strings below (40). (See FIGS. 6 and 7).

DETAILED DESCRIPTION OF THE DRAWINGS

Figures 1, 2:
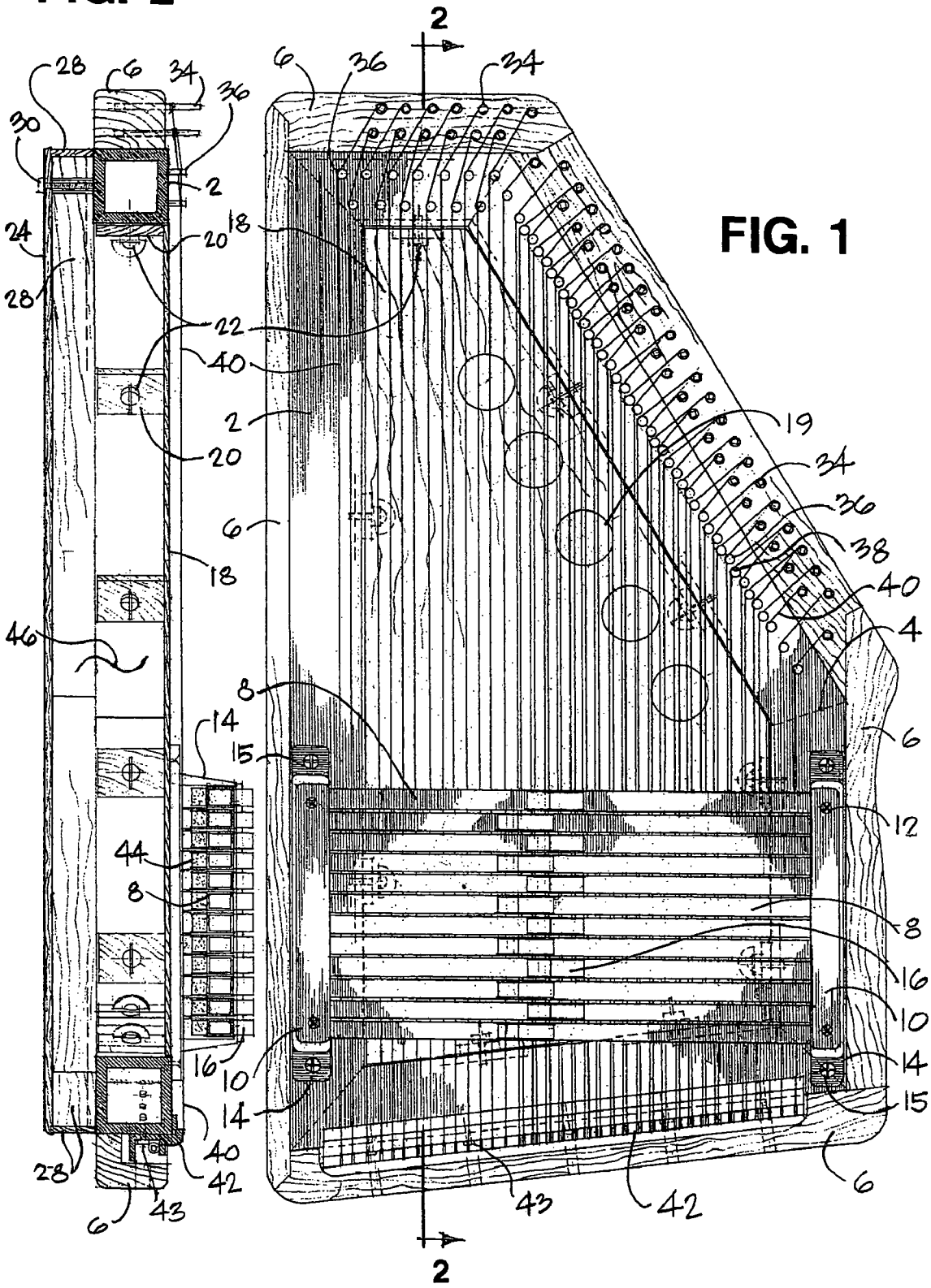
FIG. 1 is a plan view of the present invention showing the lightweight non-organic frame with interchangeable top and bottom panels (including back panel spacer ring for greater cubic volume sound chamber) and doubled strings in the melody range. (Chord bars and retaining devices are similar to the prior art.)
FIG. 2 is a longitudinal section along lines 2-2 of FIG. 1.

As seen in FIG. 1, a plan view of the present invention incorporates a self-supporting structural non-organic frame (2) supporting a multiplicity of strings (40), including doubled strings in the melody playing zone as with strings shown at bridge pin guides (36 and 38). Said strings are attached to the frame at the bottom of the instrument by a slotted bridge (42) bolted onto the non-organic frame and at the top with bridge pin guides (36) directing the strings back to tuning pegs (34) friction screw fit into the hardwood frame surround (6). A removable top soundboard panel (18) with 5 sound holes (19) attached to the non-organic frame (2) with light-weight bolts (22) fastened through wood tabs (20) glued to said removable top sound panel. The chord bars (8) are shown to be captured at each end with a retaining assembly, consisting of a slotted chord bar retaining housing (14) permanently attached to the autoharp frame (2) with screws (15) and a top chord bar keeper plate (10) affixed with screws (12). (Note: other variations of the keeper assembly may include quick release devices to allow chord bars (8) to be removed and replaced with different chord bars.)

Referring now to FIG. 2, a longitudinal section of the autoharp shown in FIG. 1 discloses the self-supporting structural non-organic frame (2) supporting a multiplicity of strings (40) affixed to the frame, and both the removable top sound board panel (18) and the back or bottom sound panel (24) with a wood spacer ring (28) standing said back panel out from said frame to create a deeper sound chamber (46) than what it would be if the back panel were directly attached to the perimeter frame. Typical chord bars (8) are shown with dense-felt string dampening pads (44) that are similar to those of the prior art.

Seen in FIG. 3 is a partial plan showing the "chord cluster" assembly (or "chord cartridge") of the present invention. Said chord cartridge is shown to consist of a slotted chord bar retaining housing (52) at each end of the chord bars (8) and connected to each by a horizontal beam (50) to form a rigid frame at each side around said chord bars. The chord bars are contained within said housing with top-mounted chord bar keeper plates (9) at each side fastened to said chord bar retaining housing with screws (12). These could also be of a quick release design to facilitate re-configuration of the chord cartridge. The chord cartridge fastens down to the instrument's frame by incorporating two horizontal pin alignment devices (66,68) at one side, a vertical alignment pin (64) at the other and a horizontally pivoting retaining tab (56) that friction slides over the retaining tab (58) which is permanently attached to the bottom of the slotted chord bar retaining housing (52). Said chord cartridge can also be positioned per the dashed lines shown (60) to use pin alignment devices (68,70) and vertical alignment pin positioning hole (62) with a horizontally pivoting retaining tab (56) locking the chord cartridge assembly down using retaining tab (54). (Note: that this chord group position allows the instrument to be played between the chord bar housing and the lower string bridge (42). Harmonic muting bridge devices (80, 82) are shown at two chord bar locations, with one a single string harmonic muter (80) and the other a double (82). Note that the autoharp shown does not have doubled strings as shown in FIG. 2 which is similar in configuration to those instruments of the prior art.

Further to be seen in FIG. 4 is a partial longitudinal section (see location on FIG. 3) cutting through the "chord cartridge" of the present invention shown in FIG. 3. The horizontal beams (50) are shown at either side of the typical chord bars (8). Said chord bars are shown with dense-felt string dampening pads (44). This section shows the position of the removable top soundboard panel (18), but with the back or bottom sound panel (24) attached without the wood spacer ring (28) shown in FIG. 2. Said back panel is attached with light weight nylon bolts (72) to the non-organic frame (2) giving the same instrument as shown in FIG. 2 a thinner, more compact configuration as an easily changeable option. Compare (46) in FIG. 2 to (47) in FIG. 4. The deeper back configuration (25) is shown in dashed lines and uses longer nylon bolts (73).

Figure 5:
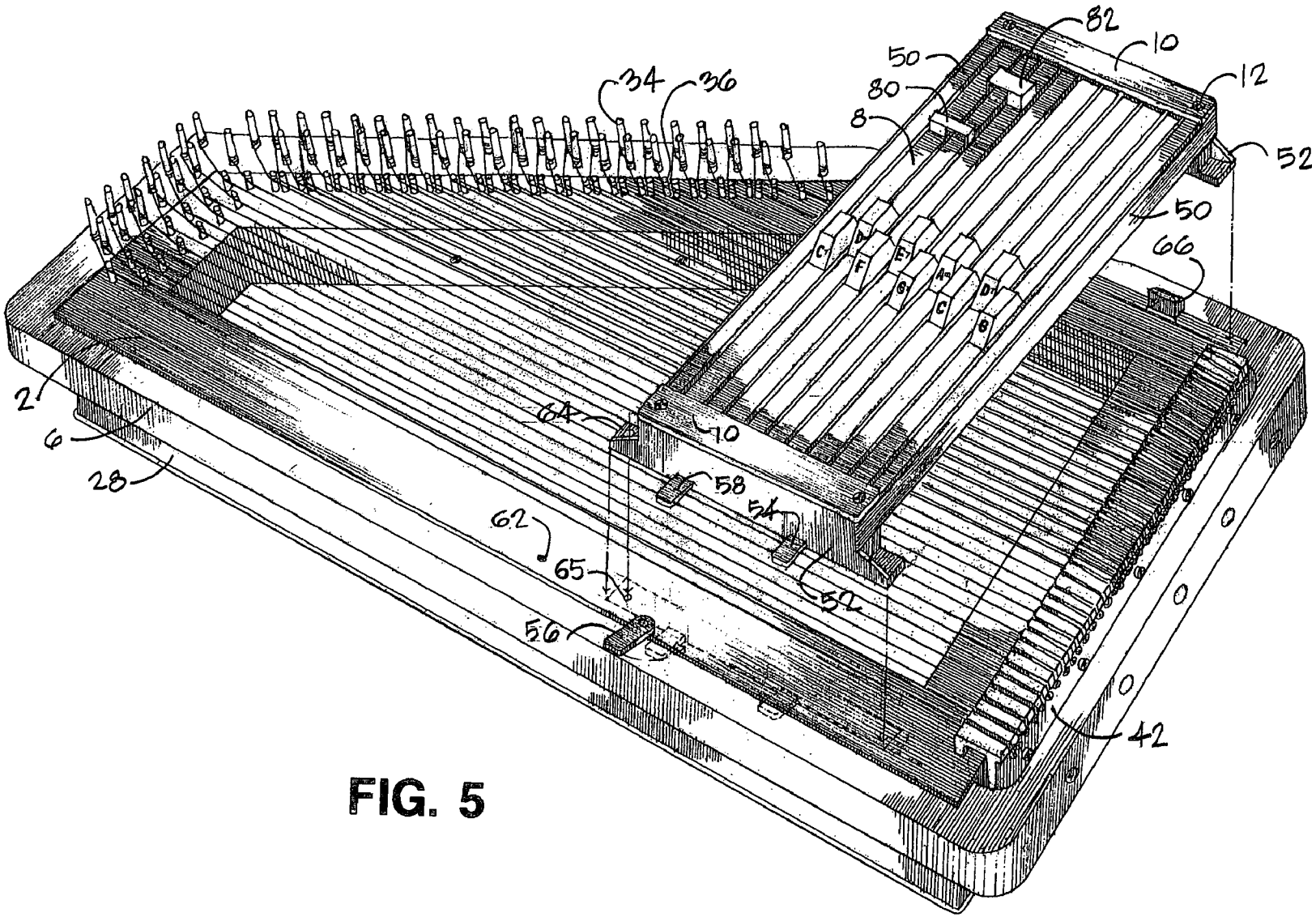
FIG. 5 is a perspective of the present invention of FIG. 1 above, but with the top panel removed to better show the independent lightweight non-organic structural frame, and with the unitized chord bar assembly of FIGS. 3 and 4 exploded from the frame of the instrument.

FIG. 5 depicts a perspective view of the chord cartridge of the present invention showing how it can be manually attached as a totally separate entity from the autoharp body containing the instrument's strings. The dashed footprint shows the contact position of the chord cartridge to the instrument's frame when firmly attached for play after inserting the chord cartridge horizontally over the two horizontal pin alignment devices (66) and vertically with the alignment pin (64) set into the frame alignment hole at (65), and horizontally pivoting the retaining tab (56) over the retaining tab (58). Note that alignment pin (64) goes into the frame alignment hole at (62) for alternate positioning of the chord cartridge for strumming and plucking closer to the base bridge (42) as described in FIG. 3 above). The harmonic muters (80, 82) are shown attached to the F and C7 chord bars. There is no separate removable top soundboard panel shown since this aspect of the invention shown in FIGS. 1 and 2 does not directly affect the function of the chord cartridge. This view also better shows the self-supporting structural frame (2). The deeper back spacer ring (28) is also shown.

FIG. 6 is a partial cross section (see cut location on FIG. 3) through one end of the chord cartridge assembly at a harmonic muter (82) attached to a specific chord bar (100) showing the other adjacent chord bars (8) with attached dense-felt string dampening pads (44) and the chord bar returning springs (90) shown at the slotted chord bar retaining housing (52). This figure shows the chord bars in the normal "up" position above the strings (40). The harmonic muter (82) consists of a standoff block (86) attached by cement or screw to a chord bar with a harmonic dampening problem (100), a bridging arm (84) attached by cement or screw to said standoff block and forming a right angle to "bridge" over the adjacent chord bar (98) and slip down between the adjacent chord bars, and terminating with a thin rubberized pad. The offensive harmonic chord sound occurs directly below chord bar (100) when its felt pad (44) impacts the string at a harmonic point on the string (94).

FIG. 7 is a partial cross section at the same location as FIG. 6 above but showing the position of the harmonic muter (82) when its attached chord bar (100) is pressed down upon the string producing an offensive harmonic sound at the point indicated by (94). Note that the rubberized tip (88) of said harmonic muter also contacts the same string at an impact point (96) sufficiently distant from the problem point at (94) that the harmonic sound is successfully dampened. In reaching this second position of impact on the same string the adjacent chord bar (98) is unaffected during play of the instrument.

Thus, as can be seen, the present autoharp utilizing a non-organic frame allows for greater flexibility in the utilization or playing of the instrument by increasing the utility and reducing the problems inherent in the current instruments.

The invention claimed is:

1. A zither, comprising:

a lightweight hollow frame supporting easily removable front and back panel members, said frame formed of a non-organic material and defining, in conjunction with the front and back panel members, a hollow boby member, said frame of sufficient strength and stability to not only be independent structurally from said front and back panel members but also to support double strings, allowing a chromatically tuned instrument to sound similar to one that is diatonically tuned by increasing the number of strings that play with a given chord, said readily removable front and back panel members facilitating changes in the instrument's appearance and sound quality.

2. A zither as in claim 1, wherein the bottom panel is configured to increase the volume of the sound chamber defined by the frame and the top and bottom panel member.

3. A zither as in claim 1 and further including interchangeable chord bar retaining assemblies; and readily releasable securement means allowing rapid interchange of the chord bar retaining assemblies whereby the player is capable of playing multiple chord groupings (keys) on a single instrument.

4. A zither as in claim 1, wherein the panel may be replaced without removing the strings.

* * * * *